US005239281A

United States Patent [19]

Tomono et al.

[11] Patent Number: 5,239,281

[45] Date of Patent: Aug. 24, 1993

[54] SMALL SIZED ELECTROMAGNETIC RELAY

[75] Inventors: Noboru Tomono, Minamisaku; Atsuto Kobayashi, Saku, both of Japan

[73] Assignee: Takamisawa Electric Co., Ltd., Tokyo, Japan

[21] Appl. No.: 926,184

[22] Filed: Aug. 7, 1992

Related U.S. Application Data

[63] Continuation of Ser. No. 722,469, Jun. 27, 1991, abandoned.

[30] Foreign Application Priority Data

Jun. 29, 1990 [JP] Japan ..... 2-68448[U]

[51] Int. Cl.[5] ..... H01H 51/22

[52] U.S. Cl. ..... 335/78; 335/128; 335/130

[58] Field of Search ..... 335/78-86, 335/124, 128, 133, 130

[56] References Cited

U.S. PATENT DOCUMENTS

| | | | |
|---|---|---|---|
| 4,600,909 | 7/1986 | Willson | 335/133 |
| 4,618,842 | 10/1986 | Nestlen et al. | 335/128 |
| 4,656,733 | 4/1987 | Maenishi et al. . | |
| 5,027,094 | 6/1991 | Yasuoka et al. | 335/78 |
| 5,049,845 | 9/1991 | Yokoyama et al. | 335/128 |

FOREIGN PATENT DOCUMENTS

| | | |
|---|---|---|
| 0332181 | 9/1989 | European Pat. Off. . |
| 0333113 | 9/1989 | European Pat. Off. . |
| 2813150 | 9/1979 | Fed. Rep. of Germany . |
| 3311308 | 10/1984 | Fed. Rep. of Germany . |
| 2618601 | 1/1989 | France . |
| 50-60552 | 6/1975 | Japan . |

*Primary Examiner*—Lincoln Donovan

*Attorney, Agent, or Firm*—Armstrong, Westerman, Hattori, McLeland & Naughton

[57] ABSTRACT

In an electromagnetic relay wherein a movable contact spring (9) and a stationary contact spring (10) are inserted by molding into a base block (8), the width of a portion of the movable contact spring and the stationary contact spring within the base block is made larger than that of a portion thereof outside of the base block.

12 Claims, 3 Drawing Sheets

SMALL SIZED ELECTROMAGNETIC RELAY

This application is a continuation of application Ser. No. 07/722,469, filed Jun. 27, 1991, now abandoned.

BACKGROUND OF THE INVENTION

1. Field of the Invention

The present invention relates to an electromagnetic relay wherein a movable contact spring and a stationary contact spring are inserted by molding into a base block.

2. Description of the Related Art

In an electromagnetic relay for an industrial apparatus, an automobile, and the like, a noise generated at a switching of contacts is transmitted to a winding, thereby erroneously operating or destroying electronic circuits connected to the winding. For this purpose, an anti-surging characteristic and an anti-noise characteristic between the winding and contacts are required for an electromagnetic relay.

When fixing contact springs to a base block, a pressure method or an inserting-by-molding method is used. According to the latter method, a thickness of mold can be made smaller than that of the former method, and this helps to reduce the size of the relay. Contrary to this, to improve the anti-surging characteristic and the anti-noise characteristic between the winding and contact springs, a distance between the winding and contact springs must be made larger, which increases the size of the relay. Therefore, in a small sized relay, it is difficult to effectively fix the contact springs to the base block, since the thickness of a mold is small but the distance between the winding and the contact springs must be large.

SUMMARY OF THE INVENTION

Therefore, an object of the present invention is to improve the anti-surging characteristic and the anti-noise characteristic in a small sized relay.

Therefore, according to the present invention, in an electromagnetic relay wherein a movable contact spring and a stationary contact spring are inserted by molding into a base block, the width of a portion of the movable contact spring and the stationary contact spring within the base block is larger than that of a portion thereof outside of the base block. Accordingly, the movable contact spring and the stationary contact springs can be effectively and reliably fixed to the base block, and this allows a substantial distance to be provided between the winding and the contact springs.

Further, according to the present invention, an electromagnetic relay is provided having an electromagnet assembly and a base block assembly for fixing said electromagnet assembly thereto, wherein the base block assembly comprises a base block, a movable contact spring, and a stationary contact spring, the movable contact spring and the stationary contact spring being inserted by molding into said base block, the movable contact spring having a slit to effectively expand the length thereof and increase the flexibility of the movable contact spring, the stationary contact spring being made approximately L-shaped to effectively increase the length thereof in accordance with the shape of the movable contact spring having the slit, the stationary contact spring being formed in a plane perpendicular to the axis of the bobbin and winding of the electromagnetic assembly, the L-shaped stationary contact spring having a vertical portion and a horizontal portion, and the movable contact spring comprising a C-shaped element having top and bottom horizontal portions defined in part by the slit and the horizontal portion of said L-shaped stationary contact spring extending along said top horizontal portion of the C-shaped element of the movable contact spring and a portion of at least one of the movable contact spring and the stationary contact spring being bent within the base block.

Additionally, according to the present invention, the electromagnetic relay is provided having an electromagnet assembly and a base block assembly for fixing the electromagnet assembly thereto, and the base block assembly comprises a base block, a movable contact spring, and a stationary contact spring, the movable contact spring and the stationary contact spring being inserted by molding into the base block, wherein the electromagnet assembly comprises a core, a bobbin for inserting the core thereinto, a winding wound on the bobbin, an armature provided in an opposite direction to the movable contact spring and the stationary contact spring with respect to the core, a card for connecting the armature to the movable contact spring, and an approximately cylindrical insulating barrier for covering the winding, the insulating barrier having an opening through which the electromagnet assembly is inserted, and wherein the insulating barrier is disposed around the bobbin and between the bobbin and the card.

Further, according to the present invention, an electromagnetic relay is provided having a electromagnet assembly and a base block assembly for fixing said electromagnet assembly thereto, and the base block assembly comprises a base block, a movable contact spring, and a stationary contact spring, the movable contact spring and the stationary contact spring being inserted by molding into the base block, wherein the electromagnet assembly comprises a core, a bobbin for inserting the core thereinto, a winding wound on the bobbin, an armature provided in an opposite direction to the movable contact spring and the stationary contact spring with respect to the core, a card for connecting the armature to the movable contact spring, the card having a first portion for fitting on an upper portion of said movable contact spring, and a second portion for inserting into a hole provided at the movable contact spring, wherein the first portion of the card comprises a groove into which a top part of the movable contact spring fits, and the second portion of the card inserts within the hole of the movable contact spring, the hole disposed adjacent the top part of the movable contact spring.

BRIEF DESCRIPTION OF THE DRAWINGS

The present invention will be more clearly understood from the description as set forth below, with reference to the accompanying drawings, wherein.

DESCRIPTION OF THE PREFERRED EMBODIMENTS

Figure 1:
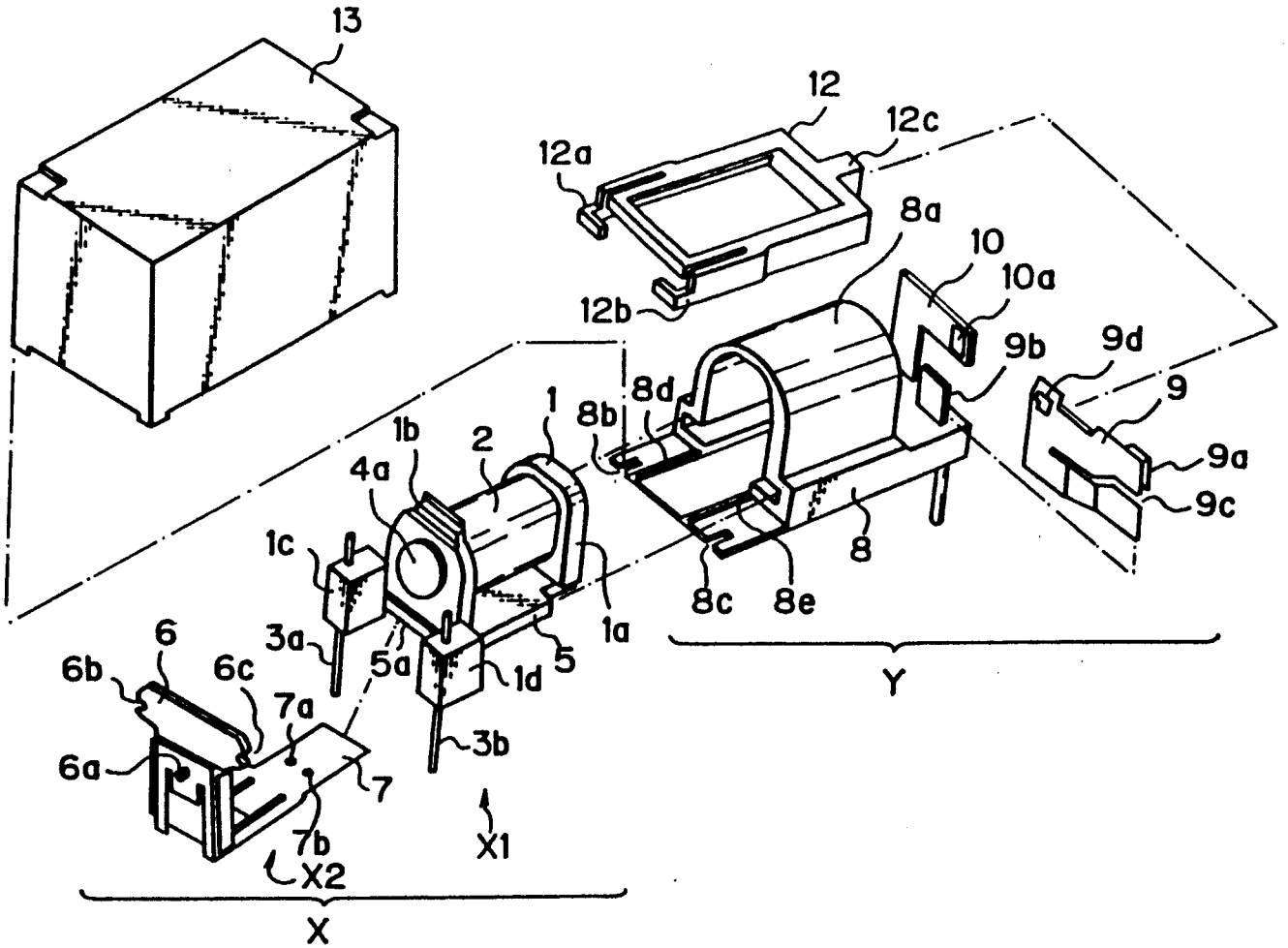
FIG. 1 is an exploded, perspective view illustrating an embodiment of the electromagnetic relay according to the present invention.
Figure 2:
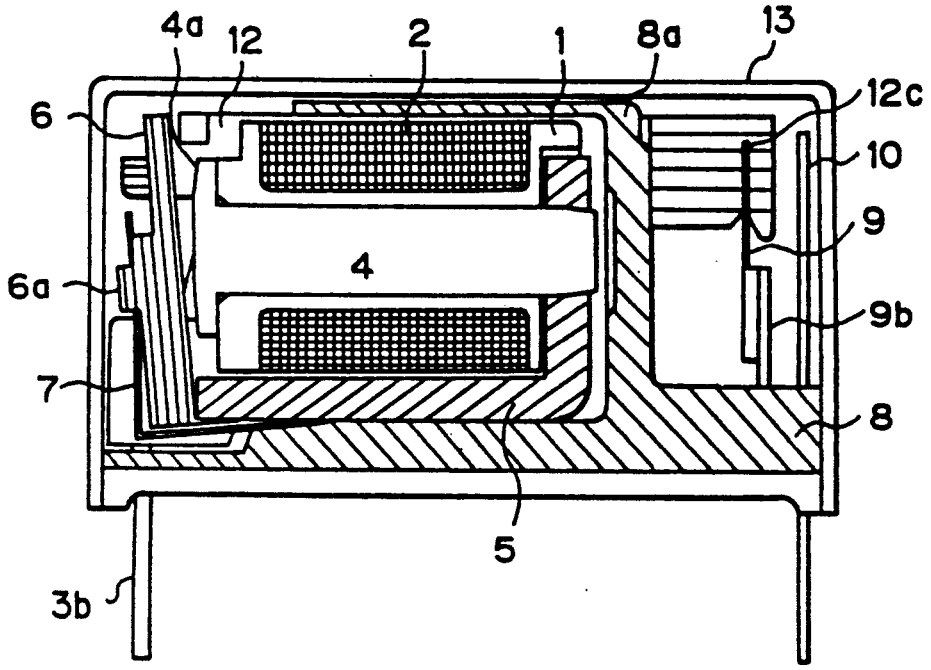
FIG. 2 is a longitudinal cross-sectional view of the assembled relay of FIG. 1.

In FIG. 1 and 2, which illustrates an embodiment of the present invention, reference X designates an electromagnet assembly, and Y designates a base block assembly.

Reference numeral 1 designates a bobbin on which a winding 2 is wound. The bobbin 1 has two collars 1*a* and 1*b*, and block-shaped portions 1*c* and 1*d* protruded from the collar 1*b*. Winding terminals 3*a* and 3*b* are inserted by pressure into the block-shaped portions 1*c* and 1*d*, respectively, and the ends of the winding 2 are fixed to the winding terminals 3*a* and 3*b*.

Reference 4 designates a core which penetrates the center of the bobbin 1 and is fixed by a yoke 5. Note, a magnetic pole portion of the core 4 is indicated by 4*a*.

Reference 6 designates an armature which is fixed to an end of a L-shaped hinge spring 7, the other end of which is fixed to the yoke 5 by inserting the protrusions (not shown) thereof into holes 7*a* and 7*b* of the hinge spring 7, whereby the electromagnet assembly X is completed.

Next, the base block assembly Y is explained below.

A base block 8 includes an approximately cylindrical insulating barrier 8*a* having an opening through which the electromagnet assembly X is inserted. Also, a movable contact spring 9 having a contact 9*a* and a terminal 9*b* and a stationary spring 10 having a contact 10*a* are inserted by molding into the base block 8. Note that the body of the movable contact spring 9 and a terminal 9*b* thereof can be formed separately or integrally.

Also, a slit 9*c* is provided at the movable contact spring 9, to thereby effectively increase the length of the movable contact spring 9, i.e., reduce the stiffness thereof. Further, the stationary contact spring 10 is approximately L-shaped, to thus effectively increase the length of the stationary contact spring 10, i.e., reduce the stiffness thereof. As a result, after the winding 2 is excited, whereby the contact 9*a* of the movable contact spring 9 is in contact with the contact 10*a* of the stationary contact spring 10, the stationary contact spring 10 can be moved to easily obtain a desired contact follow through.

Reference 12 designates a two-parallel-arm type and card for transmitting a motion of the armature 6 to the movable contact spring 9. For this purpose, curled portions 12*a* and 12*b* of the card 12 are inserted into holes 6*b* and 6*c* of the armature 6.

Also, reference 13 designates a box for accommodating the body of relay. When the body of the relay is accommodated in the box 13, the box 13 is adhered by adhesives to the base block 8. In this case, the adhesives are inserted in through holes 8*b* and 8*c* of the base block 8, but the adhesive may be spilt to form a hinge portion 5*a* of the yoke 5. To avoid this, two parallel rails (protrusions) 8*d* and 8*e* are provided at the base block 8 on the opening side of the barrier 8*a*. The parallel rails 8*d* and 8*e* are positioned inside of the block-shaped portions 1*c* and 1*d* when the electromagnet assembly X is inserted into the cylindrical insulating barrier 8*a* of the base block 8, and thus the parallel rails 8*d* and 8*e* also serve as guides for the electromagnet assembly.

Figure 3:
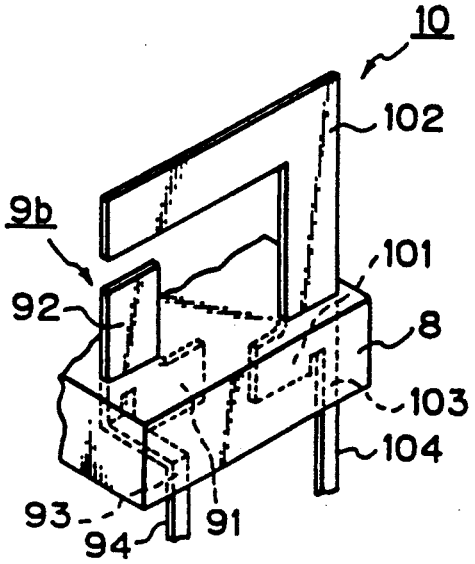
FIG. 3 is an enlarged perspective view of the contact springs of FIG. 1.

The movable contact spring 9 (in this case, the terminal 9*b*) and the stationary contact spring 10 of FIGS. 1 and 2 are explained in more detail with reference to FIG. 3.

A portion 91 of the terminal 9*b* within the base block 8 is made wider than a portion 92 of the terminal 9*b* outside of the base block 8, to ensure a secure adhesion of the terminal 9*b* of the movable contact spring 9 to the base block 8. Also, a portion 93 of the terminal 9*b* towards the external terminal 94 thereof is made slimmer. As a result, even when a large force is applied to the external terminal 94, such a large force is absorbed by the slim portion 93, to thus avoid a transformation of the movable contact spring 9.

Similarly, a portion 101 of the stationary contact spring 10 within the base block 8 is made wider than a portion 102 of the stationary contact spring 10 outside of the base block 8, to thus ensure a secure adhesion of the stationary contact spring 10 to the base block 8. Also, a portion 103 of the stationary contact spring 10 towards the external terminal 104 thereof is made slimmer. As a result, even when a large force is applied to the external terminal 104, such a large force is absorbed by the slim portion 103, to thus avoid a transformation of the stationary contact spring 10.

Also, although the movable contact spring 9 and the stationary contact spring 10 are arranged at different faces spaced along the longitudinal direction of the relay, since the slim portion 93 of the terminal 9*b* is bent, both of the external terminals 94 and 104 are arranged at the same face with respect to the longitudinal direction of the relay. The terminal 9*b* of the movable contact spring 9 is further securely adhered to the base block 8.

Figure 4A:
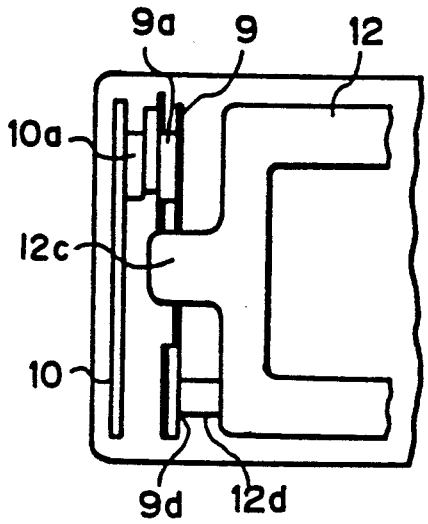
FIGS. 4A and 4B are enlarged plan and side views of the contact springs and the card of FIG. 1.
Figure 4B:
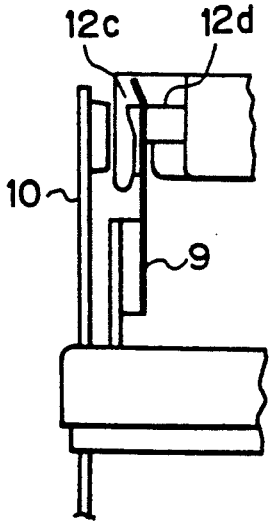
Figure 5:
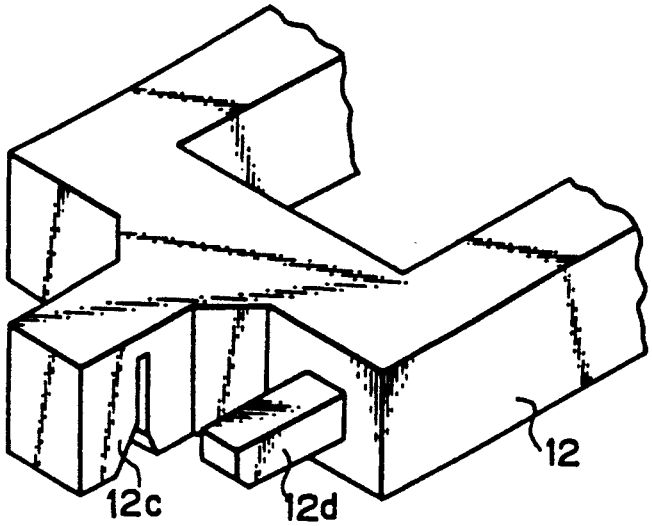
FIG. 5 is an enlarged perspective view of the card of FIG. 1.

The card 12 of FIGS. 1 and 2 is explained in more detail with reference to FIGS. 4A, 4B, and 5. That is, a portion 12*c* of the card 12 is fitted on an upper portion of the movable contact spring 9, and simultaneously, a protrusion 12*d* of the card 12 penetrates through a hole 9*d* of the movable contact spring 9, thus avoiding a separation of the card 12 from the movable contact spring 9.

According to the present invention, since the movable contact spring 9 and the stationary contact spring 10 are located on an opposite sides of the electromagnetic assembly X with respect to the base block 8, it is possible to obtain a sufficient distance between the electromagnet and the contacts, thus improving the anti-surging characteristic and anti-noise characteristic of the relay.

The assembly operation of the relay of FIGS. 1 and 2 is explained.

The winding terminals 3*a* and 3*b* are fixed by a pressure insertion thereof in the holes of the block-shaped portions 1*c* and 1*d* of the bobbin 1. Next, the core 4 is inserted in the bobbin 1 having the winding 2 thereon, and an end of the core 4 opposite to the magnetic pole face 4*a* thereof is caulked at the yoke 5, to thus complete a core assembly X1.

Further, the armature 6 is caulked at a portion 6*a* of the hinge spring 7, to thus complete an armature assembly X2.

Thereafter, holes 7*a* and 7*b* of the armature assembly X2 are fitted into the respective protrusions (not shown) of the under face of the yoke 5 of the core assembly X1, to thus complete the electromagnet assembly X.

Then, the electromagnet assembly X is inserted into the cylindrical insulating barrier 8*a* of the base block 8, and the armature 6 is linked by the card 12 to the movable contact spring 9, and thereafter, the entire relay is covered by the box 13, to thus complete the overall assembly thereof.

In this assembled relay, since the protrusion 12*d* of the card 12 is inserted into the hole 9*d* of the movable contact spring 9, the card 12 cannot be separated from the movable contact spring 9. Also, noise generated from the contacts of the movable contact spring 9 and the stationary contact spring 10 is not transmitted to the winding 2, due to the long distance therebetween, and therefore, a special noise shield is not required, which reduces the number of components.

The operation of the relay of FIGS. 1 and 2 is explained below.

In a standby state in which no current is supplied to the winding 2, a force of the hinge spring 7 and a force of the movable contact spring 9 via the card 12 are applied to the armature 6, so that the armature 6 is separated from the magnetic pole face 4*a* of the core 4, and thus the contact 9*a* the movable contact spring 9 is opened with respect to the contact 10*a* of the stationary contact spring 10.

Next, when a current is supplied to the winding 2, to excite same, the armature 6 is attracted to the magnetic pole face 4*a* of the core 4, whereby the armature 6 is rotated in the clockwise direction at the portion 5*a*. As a result, the movable contact spring 9 is moved toward the stationary contact spring 10 by a motion of the card 12 associated with the armature 6, and thus the contact 9*a* of the movable contact spring 9 abuts against the contact 10*a* of the stationary contact spring 10.

When the current supplied to the winding 2 is shut off, the relay is restored to the original state thereof by a restoring force of the movable contact spring 9 and the stationary contact spring 10.

As explained above, the electromagnetic relay according to the present invention can be made in a small size, which improves the anti-surging characteristic and the anti-noise characteristic.

We claim:

1. An electromagnetic relay having an electromagnet assembly and a base block assembly for fixing said electromagnet assembly thereto, wherein:

said base block assembly comprises a base block, a movable contact spring, and a stationary contact spring, said movable contact spring and said stationary contact spring being inserted by molding into said base block, said movable contact spring having a slit to effectively expand the length thereof and increase the flexibility of said movable contact spring, said stationary contact spring being made approximately L-shaped, to effectively increase the length thereof in accordance with the shape of said movable contact spring having said slit, said L-shaped stationary contact spring having a vertical portion and a horizontal portion, and said movable contact spring comprising a C-shaped element having top and bottom horizontal portions defined in part by said slit, said horizontal portion of said L-shaped stationary contact spring extending along said top horizontal portion of said C-shaped element of said movable contact spring.

2. An electromagnetic relay as set forth claim 1, wherein the width of a portion of said movable contact spring and said stationary contact spring within said base block is larger than that of a portion of said movable contact spring and said stationary contact spring outside of said base block.

3. An electromagnetic relay as set forth claim 1, wherein said movable contact spring has an external terminal at an extension thereof, and said stationary contact spring has an external terminal at an extension thereof, a portion of said movable contact spring and said stationary contact spring within said base block near said external terminals being partially made slimmer.

4. An electromagnetic relay as set forth claim 1, wherein said electromagnet assembly comprises:

a core;

a bobbin for inserting said core thereinto;

a winding wound on said bobbin;

an armature provided in an opposite direction to said movable contact spring and said stationary contact spring with respect to said core; and a card for connecting said armature to said movable contact spring, said card having a first portion for fitting said movable contact spring thereto, and a second portion to be inserted into a hole provided at said movable contact spring.

5. An electromagnetic relay as set forth claim 4, wherein said card further has two parallel arms.

6. An electromagnetic relay as set forth claim 1, wherein said electromagnetic assembly further comprises an approximately cylindrical insulating barrier for covering said winding, said two parallel arms of said card being positioned on both upper sides of said insulating barrier.

7. An electromagnetic relay as set forth claim 1, wherein said electromagnet assembly is located at a distance from said movable contact spring and said stationary contact spring, to obtain an insulating effect therebetween.

8. An electromagnetic relay as set forth claim 1, wherein said base block has two parallel rails along an inserting direction of said bobbin.

9. An electromagnetic relay having an electromagnet assembly and a base block assembly for fixing said electromagnet assembly thereto, and said base block assembly comprises a base block, a movable contact spring, and a stationary contact spring, said movable contact spring and said stationary contact spring being inserted by molding into said base block, wherein said electromagnet assembly comprises:

a core;

a bobbin for inserting said core thereinto;

a winding wound on said bobbin;

an armature provided in an opposite direction to said movable contact spring and said stationary contact spring with respect to said core; and a card for connecting said armature to said movable contact spring, said card having two elongated portions extending from said armature to said movable contact spring along an axis of said core and bobbin; and an approximately cylindrical insulating barrier for covering said winding, said insulating barrier having an opening through which said electromagnet assembly is inserted and wherein said insulation barrier is disposed around said bobbin and between said bobbin and said card, and between said two elongated portions of said card.

10. An electromagnetic relay having an electromagnet assembly and a base block assembly for fixing said electromagnet assembly thereto, and said base block assembly comprises a base block, a movable contact spring, and a stationary contact spring, said movable contact spring and said stationary contact spring being inserted by molding into said base block, wherein said electromagnet assembly comprises:

a core;

a bobbin for inserting said core thereinto;

a winding wound on said bobbin;

an armature provided in an opposite direction to said movable contact spring and said stationary contact spring with respect to said core; and a card for connecting said armature to said movable contact spring, said card having a first portion for fitting on an upper portion of said movable contact spring, and a second portion for inserting into a hole provided at said movable contact spring, wherein said first portion of said card comprises a groove into which a top part of said movable contact spring fits, and said second portion of said card inserts within said hole of said movable contact spring, said hole disposed adjacent said top part of said movable contact spring.

11. An electromagnetic relay as set forth claim 10, wherein said core and bobbin are substantially cylindrical and define a central axis, and wherein said card is substantially in the shape of a rectangle having two length portions extending parallel to said central axis and first and second width portions extending perpendicular thereto, said first and second card portions formed on said first width portion.

12. An electromagnetic relay as set forth claim 1, wherein said electromagnet assembly comprises a bobbin having a winding therearound and an axis, and said stationary contact spring is formed in a plane perpendicular to the axis of the bobbin and winding.

* * * * *